United States Patent [19]

Yamamoto

[11] Patent Number: 4,909,018

[45] Date of Patent: Mar. 20, 1990

[54] CONTROL DEVICE AND METHOD FOR CONTROLLING THE DRIVING SYSTEM OF A PACKAGING MACHINE

[75] Inventor: Masaru Yamamoto, Iruma, Japan

[73] Assignee: Omori Machinery Co., Ltd., Saitama, Japan

[21] Appl. No.: 193,272

[22] Filed: May 11, 1988

[30] Foreign Application Priority Data

May 13, 1987 [JP] Japan ..... 62-114482
May 13, 1987 [JP] Japan ..... 62-114484

[51] Int. Cl.[4] ..... B65B 57/08

[52] U.S. Cl. ..... 53/450; 53/51; 53/55; 53/493; 53/550

[58] Field of Search ..... 53/51, 55, 54, 75, 450, 53/493, 550

[56] References Cited

U.S. PATENT DOCUMENTS 4,506,488 3/1985 Matt ..... 53/55
4,549,386 10/1985 Wilson .
4,712,357 12/1987 Crawford ..... 53/550
4,726,168 2/1988 Seko ..... 53/51 X

*Primary Examiner*—John Sipos
*Attorney, Agent, or Firm*—Wenderoth, Lind & Ponack

[57] ABSTRACT

In a packaging machine in which a leading unit for advancing a film web and forming it into a continuous tubular shape during its travel, a feeding unit for supplying articles to be wrapped into the film tube, and a cutting unit for at least sealing the film tube along the transverse direction, are driven by independent motors, a method for controlling the motors includes controlling the running speeds of the motors for the feeding unit and the sealing unit on the basis of the running speed of the motor for the leading unit. A control device for carrying out such a method includes detectors for detecting conditions including positions of the leading unit, feeding unit and sealing unit, and a control unit connected to the detectors for controlling the motors of the feeding unit and the sealing unit on the basis of signals from the detector which detects operating conditions of the leading unit.

13 Claims, 2 Drawing Sheets

CONTROL DEVICE AND METHOD FOR CONTROLLING THE DRIVING SYSTEM OF A PACKAGING MACHINE

BACKGROUND OF THE INVENTION

1. Field of the Invention

The present invention generally relates to a packaging machine which is automatically controlled to perform a wrapping operation. More particularly, the present invention relates to improvements in a control device and a method for controlling a driving system of the packaging machine.

2. Description of the Prior Art

In order to produce a wrapped article by using, for example, a horizontal pillow-type packaging machine, a web of continuous film is led from a film stocker containing a rolled film and is then formed into a tube during its travel. After articles are filled into the film tube at predetermined intervals, the film tube is sealed transversely with respect to the film running direction between the adjacent articles and optionally is cut at the sealed portions. The film web is often printed with ornamental designs, characters, pictures and the like at regular intervals.

The above packing operation requires a coordination among the feeding position of the article to be packed, the cutting and sealing position of the film between each article, and the leading timing of the film web so that the print is arranged at a correct position on the wrapped article.

A typical packaging machine employs a single driving motor from which driving power is transmitted to all driven units through various transmissions such as cam and gear mechanisms, but the machine should be pre-adjusted to perform the above positioning operation in a complicated manner prior to its operation. More specifically, each of the transmissions should be released from the motor so that a position of each driven unit can be temporarily adjusted. Then the driven unit is connected to the motor and subjected to test running to check whether the machine properly works or not. If the positions are not coordinated, the transmission should be released from the motor again to re-adjust the driven units. Thus, the initial setting of the machine is a time-consuming and troublesome process.

Recently, a packaging machine has been developed which includes a plurality of driving motors for respective driven units. Since these driving motors can be independently operated, the initial adjustment of the driven units can be easily and correctly performed. In such a multi-motor machine, a control operation is essentially required to synchronize the motors to each other so that the normal wrapping operation subsequent to the initial adjustment may be carried out smoothly and accurately. A typical example of such a control operation is disclosed in Japanese Pat. KOKAI document No. 61-259927 in which motors for the film leading unit and for the sealing and cutting unit, respectively, are controlled with a motor for the feed unit being a reference. Specifically, the feed unit is driven at a constant running speed, while the film traveling speed is controlled through a detection of register marks at which the film is to be cut and the cutting and sealing unit is also controlled to vary its rotational speed as well as its engaging timing.

In the initial adjustment, an attachment or a so-called flight that is formed on the feed unit to forward the article is stopped at any appropriate position. Because a distance between the flight and the cutting and sealing unit can be calculated, an initial position of the latter unit can also be calculated based on the calculated distance and other factors including an angle of rotation of the unit over a period of time during which the article is to travel from the flight to a position adjacent the unit. Therefore, the cutting and sealing unit may be correctly positioned relative to the feed unit. On the other hand, the register marks on the film web are detected by a sensor which sends to a control unit a signal for stopping the travel of the film web so that the register mark stops at a reference detection location of the sensor. The sensor is stationarily fixed adjacent the film stocker and a distance between the sensor and the cutting and sealing unit is constant. Thus, the initial position of the film web determined by the sensor does not always coincide with the initial position of the cutting and sealing unit which has been determined to coordinate the same with the feed unit, resulting in a difficulty in the initial adjustment of the film traveling unit.

During the subsequent wrapping operation, the feed unit runs at a constant speed as mentioned above. If an interval between adjacent register marks, which is detected by the sensor, is different from a preset or input value due to a printing error or an elongation of the film itself, the film traveling speed as well as the rotational speed of the cutting and sealing unit is varied so that each article may be packed at the correct position. However, such variation in the film speed which is caused each time the sensor detects the interval difference renders the film tension unstable, causing the film to fluctuate during its travel and preventing the cutting and sealing unit from functioning as desired. Further, the film fluctuation or waving continues after the film is formed into the tube into which the articles are supplied. This tends to displace the articles relative to the film tube that is to be cut at regular intervals. Additionally, the peripheral speed of the cutting and sealing unit must coincide with the film speed while they are in contact with each other. Thus, the peripheral speed should be varied whenever the film speed changes. However, such a control is very complicated since there is no direct association between the controllers of the motor for the cutting and sealing unit and the motor for the film traveling unit.

BRIEF SUMMARY OF THE INVENTION

It is therefore an object of the present invention to provide a control device for controlling the driving system of a packaging machine in which each driving motor can be exactly controlled in a relatively easy manner.

Another object of the invention is to provide a control device for controlling the driving system of a packaging machine which enables correct adjustment of relative positions of a film, a feed unit, and a cutting and sealing unit.

Still another object of the invention is to provide a control device for controlling the driving system of a packaging machine which can wrap articles with so as to exhibit a good external appearance.

Still another object of the invention is to provide a control device for controlling the driving system of a packaging machine which can improve the efficiency of wrapping process.

A further object of the present invention is to provide a control method for controlling the driving system of a packaging machine by which driving motors can be coordinated together to perform correct wrapping operations.

Still another object of the invention is to provide a control method for controlling the driving system of a packaging machine which facilitates adjustment of relative positions of a film, a feed unit, and a cutting and sealing unit.

It is still another object of the invention to provide a control method for controlling the driving system of a packaging machine which may prevent a film from fluctuating or waving during its travel.

To accomplish the above objects, a control device according to the present invention is applied to a packaging machine which includes film leading means for leading a film web and forming it into a continuous tubular shape during its travel, the leading means having a third driving motor therefor, means for feeding articles to be wrapped and supplying the articles into the film tube at intervals, the feeding means having a first driving motor therefor, and means for at least sealing the film tube along a direction transverse to a film traveling direction, the sealing means having a second driving motor therefor. The control device comprises detecting means for detecting conditions including positions of the leading means, feeding means and sealing means, and control means connected to the detecting means for controlling the first, second and third motors in such a manner that the first and second motors are controlled on the basis of signals from the detecting means which detects the leading means.

According to another aspect of the invention, a method for controlling the driving motors in the packaging machine of the type set forth above, comprises controlling the running speeds of the first and second driving motors on the basis of the running speed of the third driving motor.

In accordance with the system of the invention, the driving motors can be accurately controlled in a relatively easy manner so that the packaging machine may perform a desired operation. Also, the system prevents the film traveling speed from being subjected to frequent variations which would cause fluctuation or waving of the film.

Other objects, features and advantages of the invention will be apparent from the following detailed description of preferred embodiments thereof when taken in conjunction with the accompanying drawings.

DETAILED DESCRIPTION OF THE PREFERRED EMBODIMENTS

Preferred embodiments of the present invention will be described in conjunction with the accompanying drawings in which a horizontal pillow-type machine is illustrated as a typical example of packaging machinery to which the invention is applied. It is, however, to be noted that the invention is also applicable to any other packaging machine having a similar driving system.

Figure 1:
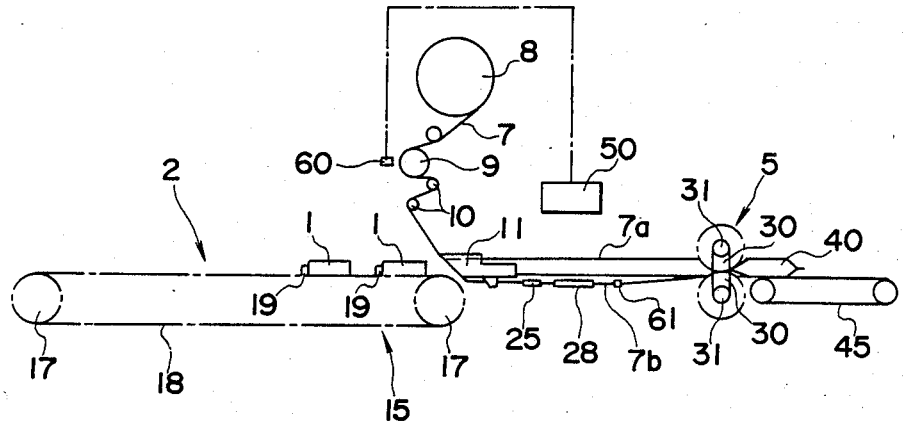
FIG. 1 is a schematic side view of a packaging machine incorporating a preferred embodiment of a control device according to the invention.
Figure 2:
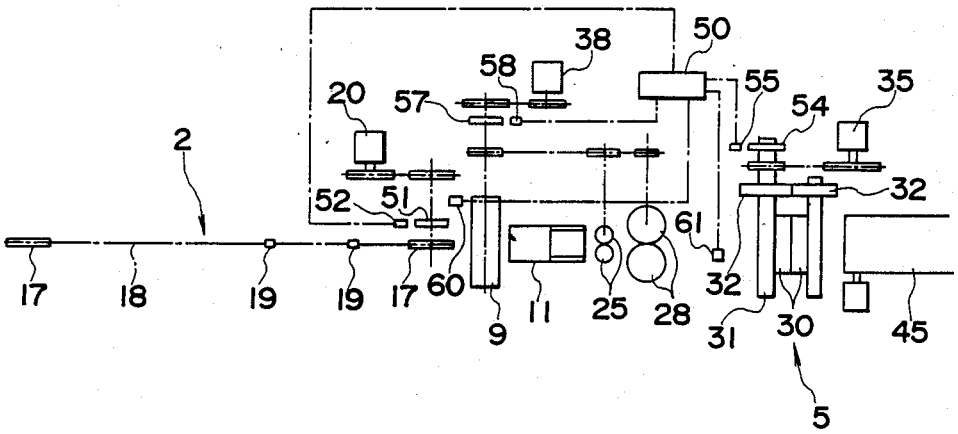
FIG. 2 is a schematic plan view of the machine of FIG. 1.

Referring first to FIGS. 1 and 2 of the drawings, articles 1 to be wrapped are conveyed by a feed unit 2 at predetermined intervals, and a cutting and sealing unit 5 is provided at a position downstream of the feed unit 2. A film stocker 8 is arranged above the feed unit 2 and contains a rolled web-shaped film 7, hereinafter referred to as "film web", which is fed towards the feed unit 2 through a leading roller 9 and a plurality of tension rollers 10. Register marks (not shown) are printed on the side edge of the film web 7 at predetermined intervals for indicating points at which the film is to be cut in the transverse direction, i.e. in the direction perpendicular to its traveling direction, by the unit 5. Mounted adjacent the downstream end of the feed unit 2 is a bag making assembly 11 in which the film web 7 is introduced and is formed into a tubular shape. The article 1 conveyed by the unit 2 is supplied into the film tube **7*a* within the assembly 11**.

The feed unit 2 includes a conveyer 15 for conveying the articles 1 prior to wrapping. The conveyer 15 comprises a pair of sprocket wheels 17—17, an endless chain 18 extending around the sprocket wheels, and a plurality of attachments or flights 19 arranged on the endless chain 18 at predetermined intervals. One of the sprocket wheels 17 is mechanically connected to a first driving motor 20 through a power transmission such as sprocket wheel, chains, gears and the like. Driving power from the first driving motor 20 thus moves the endless chain 18 with the flights 19.

The cutting and sealing unit 5 has a pair of end sealers 30—30 arranged one above the other whose rotational axes 31—31 extend transversely with respect to the film running direction. Gears 32—32 are fixed to the ends of respective axes 31—31 and are engaged with each other so that the rotational movements of the gears are synchronized. The axis 31 of the lower sealer 30 is connected to a second motor 35 through a transmission mechanism for rotating the gear. The film tube **7*a* is continuously introduced into the unit 5 where it is transversely cut and heat-sealed cyclically by the engagement of the pair of end sealers 30 as shown in FIG. 1. After a predetermined period of engagement, the end sealers 30 are moved away from each other to permit a certain length of the film tube 7*a* as well as the article 1 therein to pass through the unit 5**.

Provided adjacent the outlet of the assembly 11 are a pair of rollers 25—25 which are arranged to contact each other to nip therebetween the overlapped longitudinal edges **7*b* of the film tube 7*a*, so that the rotational movement of the rollers 25 advances the film tube 7*a*. Downstream of the rollers 25, a pair of rollers or so-called center sealers 28—28 are provided to seal the overlapped edges 7*b* together as the film tube 7*a* advances, the sealed edges extending at the bottom center of the film tube 7*a*. The seal is usually effected by means of heat. These rollers 25 and 28 are mechanically connected to a third driving motor 38 which is also connected to the film leading roller 9 via a transmission mechanism, and thus the rotation of the rollers 25 and 28 are synchronized with the rotation of the leading roller 9. All of these rollers 9, 25 and 28** constitute a film leading unit.

A carry-out conveyer 45 extends in the downstream direction to transport completely wrapped articles 40 from the unit 5 to any succeeding work station.

The first, second, and third driving motors 20, 35 and 38 are electrically connected to a control unit 50, and their rotational speeds are independently controlled by signals from the control unit 50. Specifically, the control unit 50 is adapted to calculate a rotational speed of each of the first and second driving motors 20 and 35 based on data including the rotational speed of the third driving motor 38, an interval for cutting the film tube 7*a* (i.e. cut pitch) and the like, and to send control signals depending on the calculated result to the first and second driving motors 20 and 35. According to this control method the first and second driving motors 20 and 35 are operated in synchronism with the third driving motor 38 through the control unit 50, and in this sense the third motor 38 is used as a reference in controlling the other motors.

A first encoder 51 is coaxially mounted to the sprocket wheel 17 of the feed unit 2 connected to the first driving motor 20, in order to detect a number of revolutions and an angle of rotation of the sprocket wheel 17 in cooperation with a first position sensor 52 which is disposed adjacent the first encoder 51. The sensor 52 also detects the flights 19 when the latter are moved to a predetermined reference position. Similarly, the lower end sealer 30 is provided on its axis 31 with a second encoder 54 and a second position sensor 55 which detect an angle of rotation of the end sealer 30. Further, a third encoder 57 and a third position sensor 58 are arranged coaxially with the film leading roller 9 to detect an angle of rotation as well as a rotational speed of the roller 9.

Disposed adjacent the periphery of the leading roller 9 is a detector 60 which is adapted to detect the register marks on the side edge of the film web 7. Also, an auxiliary detector 61 is located between the center sealers 28 and the end sealers 30 for detecting the register marks on the film 7 that is tubular there.

The control unit 50 is electrically connected to the above encoders 51, 54 and 57 and sensors 52, 55 and 58 as well as to the detectors 60 and 61 so that the information obtained by these encoders, sensors and detectors is input to the unit 50. The control of the motors 20, 35 and 38 is performed on the basis of the input data. In the illustrated embodiment, the sensors and the detectors comprise photoelectric tubes, but various other devices such as microswitches and proximity switches may be employed.

Preferably, the control unit 50 includes means for storing data from the detector 60 representing each interval between the adjacent register marks on the film web 7 and for comparing subsequently input data from the detector 60 with the stored data.

Figure 3:
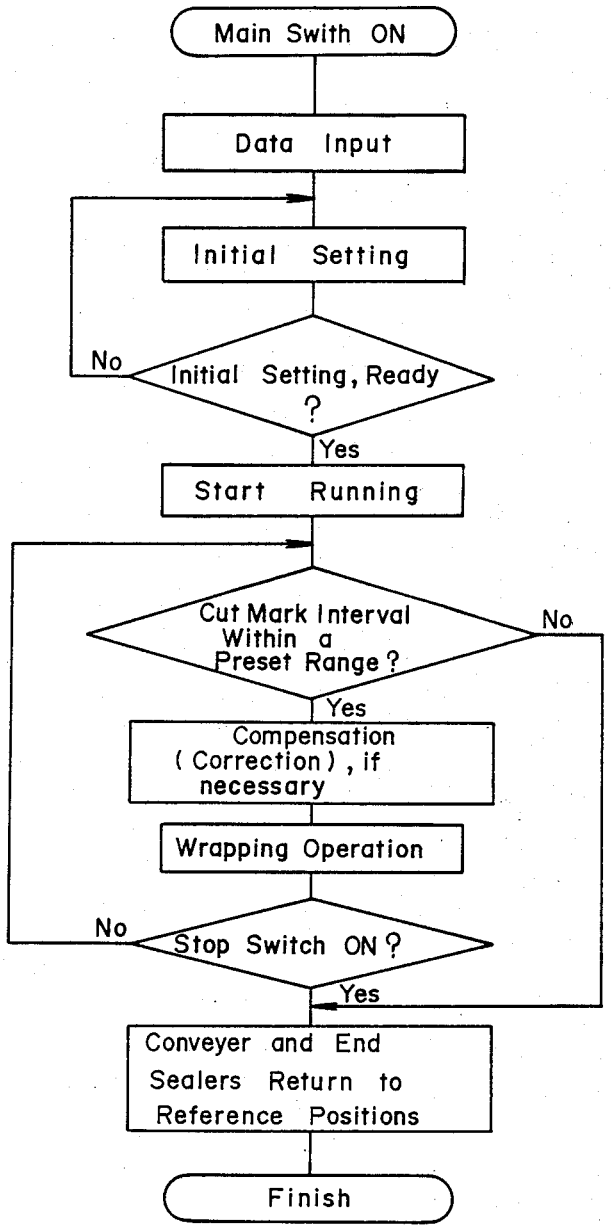
FIG. 3 is a flow chart illustrating a preferred embodiment of a control method in the packaging machine.

The operation of the above packaging machine will now be described with reference to FIG. 3 which shows sequential steps of control. First, a main switch of the machine is turned on and then various data are input to the control unit 50. The data includes fixed data representing an interval of the flights 19 (i.e. flight pitch), a length of the film to be sealed by the end sealers 30, a radius of the end sealer 30 and the like that are inherent to the machine, and variable data representing a size of the article to be wrapped, a cut pitch of the film etc. that varies depending on the article. The next step is an initial setting or a positioning of the film leading unit, the feed unit 2 and the cutting and sealing unit 5. This step comprises two sub-steps: a first sub-step to move the flights 19 of the conveyer 15, the end sealers 30 and the film 7 to respective reference positions and a second sub-step to shift these parts so that their relative positions are adjusted to agree with each other.

In detail, the positioning operation is performed as follows. The conveyer 15 is moved by the first motor 20 until one of the flights 19 (the foremost flight in FIG. 1) is detected by the first position sensor 52, and is stopped there when the flight 19 is adjacent the inlet of the assembly 11, this being the reference position of the flight 19. In the cutting and sealing unit 5, the upper end sealer 30 is rotated until it faces upwardly while the lower end sealer 30 is rotated to face downwardly, that is, each of these sealers is rotated 180 degrees from the position in FIG. 1 where the sealers are engaged with other. This step of establishing the reference position of the unit 5 is carried out by the second motor 35 under a control based on the signals from the second encoder 54 and the second position sensor 55. The leading roller 9 is rotated, together with the rollers 25 and the center sealers 28, by the third motor 38 and is stopped when the detector 60 detects the register mark on the film web 7, whereby the film is set to the reference position where the register mark faces the detector 60. The first sub-step is thus completed.

For the next sub-step, the control unit 50 calculates the number of register marks that exist between the detector 60 and the end sealers 30 as well as a distance between the end sealers 30 and the nearest register mark, on the basis of the cut pitch and a distance between the detector 60 and the end sealers 30 stored in the unit 50. Further calculated is a distance of travel of the film 7 over a period of time during which the end sealers 30 rotate to the engaging position, based on a predetermined film traveling speed on which the rotational speed of end sealers 30 depend. By comparing the calculated position of the register mark nearest the end sealers 30 with the calculated film traveling distance, a position of the register mark is adjusted by advancing the film 7 a certain distance obtained as a result of the comparison so that the register mark reaches the unit 5 when the end sealers 30 engage each other. The film advance is accomplished by the third motor 38 which drives the leading roller 9 under a control based on signals from the third position sensor 58. Similarly, the control unit 50 calculates a suitable position of the flight 19 and the first motor 20 drives the conveyer 15 to shift the flight 19 to the calculated position under a control based on signals from the first position sensor 52, etc. In this manner, various units are positioned relative to each other and the packaging machine is ready for performing a normal wrapping operation.

The auxiliary detector 61 in the illustrated embodiment serves to ensure the exact initial setting by compensating for a difference between a designed value and an actual value of the distance from the detector 60 to the end sealers 30, which difference might arise due to a displacement of the tension rollers 10 as well as an elongation or contraction of the film itself. The actual distance is measured by advancing the register mark on the film from the reference position to a position where the same mark is detected by the auxiliary detector 61, calculating a distance of the film travel on the basis of the rotation of the leading roller 9, and by adding a distance between the auxiliary detector 61 and the end sealers 30 to the calculated distance. This measured distance is stored in the control unit 50 for use in the initial setting as described above.

When the control unit 50 determines that the initial setting is completed, it sends signals to the driving motors 20, 35 and 38 which in turn start to run for facilitating the wrapping operation. It is, however, to be noted here that the cut pitch, i.e. the interval between adjacent register marks, of the film is sometimes different from the input value due to a printing error and the elasticity of the film, and the illustrated embodiment includes a compensation system for such irregularity. The system comprises continuously monitoring the register marks throughout the wrapping operation and adjusting the running speed of the feed unit 2 and the cutting and sealing unit 5 when the irregularity is detected, so that the film 7 may always be cut at the register marks and so that the article 1 may always be set at a desired position within the sealed bag. Specifically, the compensation is conducted as follows.

The detector 60 detects each register mark on the film web 7 running at a constant speed and the control unit 50 determines in cooperation with the third encoder 57 and the third position sensor 58 whether the intervals of the adjacent register marks agree with the stored value. So far as no irregularity is detected, the wrapping operation continues without changing the running speed of the motors 20 and 35. When the control unit 50 determines that the irregularity exists, it further determines whether the detected irregularity is within a certain range which has been preset and stored in the unit 50 prior to the wrapping operation. If the irregularity is within that range, the control unit 50 changes the running speed of the first and second motors 20 and 35. Specifically, if the register mark interval is larger than the stored value, the motors 20 and 35 are decelerated, respectively, to the speed of the conveyer 15 and to elongate the time interval for the engagement of end sealers 30. On the other hand, if the register mark interval is smaller than the stored value, the control unit 50 accelerates the motors 20, 35.

The above compensation may be executed whenever the irregularity within the preset range is detected. In the continuous wrapping operation, however, usually the interval difference of the register marks from the stored or preset value is substantially constant, that is, the intervals are usually longer (or shorter) by a substantially constant value. Thus, in the preferred embodiment of the invention, the control unit 50 stores the register mark interval detected through the detector 60 and compares it with the subsequently input intervals to determine whether the interval difference from the preset value is constant. If determined constant, the preset data is corrected to and replaced with the actual interval. Then the running speed of the third motor 38 is calculated based on the corrected value of the interval and on stored data concerning a number of the wrapped articles 40 to be produced per unit time, and the control unit 50 controls the motor 38 to vary its speed according to a calculated result. The running speeds of the first and second motors 20 and 35, respectively, are also coordinated with the reset speed of the third motor 38. For example, if the register mark intervals are longer than the preset value, the third motor 38 is accelerated to increase the film traveling speed while the second motor 35 is controlled to increase the peripheral speed of the end sealers 30 in a zone where the sealers are in contact with the film 7. The first motor 20 is also adjusted such that the traveling speed of the flight 19 is increased in a zone where the article 1 is delivered from the conveyer 15 into the film tube 7*a*.

The above control permits the packaging machine to produce the wrapped articles 40 at a constant rate even when the actual register mark intervals are different from the preset data. Further, once the interval data is corrected, it is no longer necessary to repeat the compensation for the first and second motors 20 and 35 as long as the interval difference is constant, resulting in a stable wrapping operation with the constant running speed of the motors.

Monitoring of the register mark intervals continues throughout the wrapping operation, that is, until a stop switch is turned on. If the interval difference is out of the preset range, the control unit 50 sends stop signals to all driving motors 20, 35 and 38 for discontinuing the wrapping operation. The entire machine also stops when the stop switch is turned on. At this time, the first and second motors 20 and 35 are energized for a while until the flights 19 and the end sealers 30 moves to the above-mentioned reference positions, ready for the next operation.

If is desired to use a film having no ornamental designs and therefore no register marks thereon, the packaging machine, after the initial setting in the above described manner, carries out the wrapping operation in which the running speeds of the first and second motors 20 and 35 are determined on the basis of the running speed of the third motor 38 and other input data including a film cut pitch. The wrapping operation continues without any compensation and correction, because there are no registor marks on the film to be monitored.

As can be understood from the foregoing description, according to the invention, plural driving motors can be exactly controlled to coordinate their running speeds and the initial setting or positioning of the feed unit, cutting and sealing unit and the film leading unit may automatically be accomplished accurately, so that a desired wrapping operation can be performed. Additionally, since the film travels at a substantially constant speed, the film is prevented from fluctuating or waving during its travel which would arise if the film speed were to vary frequently.

Although the invention has been described in detail and with reference to specific embodiments thereof, it will be apparent to those skilled in the art that various changes and modifications can be made therein without departing from the spirit and scope of the invention.

What is claimed is:

1. In a packaging machine including film leading means for leading a film web having register marks thereon and forming the film web into a continuous tubular shape during the course of travel thereof, said film leading means including a third driving motor of the packaging machine, article feeding means for feeding articles to be wrapped into the tubular film at intervals, said article feeding means including a first driving motor of the packaging machine, and sealing means for at least sealing the film having a tubular shape in a direction transverse to the course of travel of the film, said sealing means including a second driving motor of the packaging machine, a control device for controlling said driving motors comprising:

detecting means for detecting operating conditions of the packaging machine including the respective relative operational positions of said film leading means, said article feeding means and said sealing means, for detecting the register marks on the film web as the film web is lead by said film leading means and for issuing signals indicative of the detections; and control means connected to said detecting means and to said driving motors for controlling said first, said second and said third driving motors and for monitoring actual intervals between adjacent ones of the register marks detected by said detecting means as the film web is lead by said film leading means, said control means controlling said first and second driving motors on the basis of the signals issued by said detecting means indicative of the operation condition of said film leading means, said control means including storage means for storing a previously detected actual interval between two adjacent ones of the register marks, comparing means for comparing the previously detected actual interval with subsequently detected actual intervals monitored by the control means, and determination means for determining whether the actual intervals between adjacent ones of the register marks are different from the stored interval by a substantially constant amount, said control means adjusting the running speed of said third driving motor when the actual intervals between adjacent ones of the register marks are different from the stored interval by a substantially constant amount.

2. A control device as claimed in claim 1, wherein said control means also adjusts the running speeds of said first and said second driving motors on the basis of the actual intervals between the adjacent ones of the register marks.

3. A control device as claimed in claim 1, wherein said control means includes means for changing the interval stored by said storage means to an interval corresponding to the actual intervals between adjacent ones of the register marks when different from the stored interval by a substantially constant amount.

4. A control device as claimed in claim 1, further comprising auxiliary detecting means for detecting the register marks and for issuing signals indicative of the detection, said auxiliary detecting means being connected to said control means and being arranged at a position downstream of said detecting means in the packaging machine, and wherein said control means includes calculating means for calculating the actual distance between one of the register marks detected by said detecting means and the sealing means of the packaging machine.

5. A control device as claimed in claim 1, wherein said feeding means includes a sprocket wheel operatively connected to said first driving motor so as to be driven by said first motor and a plurality of flights entrained about said sprocket wheel at regular intervals for feeding the articles, and wherein said detecting means detects the rotational speed and angle of rotation of said sprocket wheel as well as a relative operational position of said flights.

6. A control device as claimed in claim 1, wherein said sealing means comprises a pair of end sealers adapted to cyclically engage each other to seal and cut the film having a tubular shape, and wherein said detecting means detects a relative operational position of said end sealers.

7. A control device as claimed in claim 1, wherein said film leading means includes a leading roller operatively connected to said third driving motor so as to be driven by said third motor, and wherein said detecting means detects the rotational speed and angle of rotation of said leading roller.

8. A control device as claimed in claim 7, wherein said film leading means comprises a bag making assembly disposed downstream of said leading roller with respect to the course of travel of the film web for forming the film web into the tubular shape, and a pair of center sealers for sealing together the longitudinal edges of the film having the tubular shape, said center sealers operatively connected to said third driving motor so as to be driven by said third motor.

9. A method of controlling driving motors in a packaging machine including film leading means for leading a film web having register marks thereon and forming the film web into a continuous tubular shape during the course of travel thereof, said film leading means including a third driving motor of the packaging machine, article feeding means for feeding articles to be wrapped into the film tube at intervals, said article feeding means including a first driving motor of the packaging machine, and sealing means for at least sealing the film having a tubular shape in a direction transverse to the course of travel of the film, said sealing means including a second driving motor of the packaging machine, said method comprising controlling the running speeds of said first and said second driving motors on the basis of the running speed of said third driving motor, detecting the register marks on the film and monitoring actual intervals between adjacent ones of the register marks, storing a detected actual interval between adjacent ones of the register marks in a memory, comparing the stored interval with subsequently detected actual intervals between adjacent ones of the register marks, determining whether the subsequently detected actual intervals are different from the stored interval by a substantially constant amount, changing the running speed of the third driving motor when the subsequently detected actual intervals are different from the stored interval by a substantially constant amount.

10. A control method as claimed in claim 9, further including the step of adjusting the running speeds of said first and said second driving motors on the basis of the actual intervals between adjacent ones of the register marks.

11. A control method as claimed in claim 9, wherein the step of changing the running speed of the third driving motor includes the steps of changing the stored interval to a value corresponding to the subsequently detected actual intervals when substantially constant and of calculating the running speed of said third driving motor on the basis of said value.

12. A control method as claimed in claim 9, further comprising an initial step of coordinating the relative position of the film and the respective relative operational positions of said article feeding means and said sealing means.

13. A control method as claimed in claim 12, wherein said coordinating step comprises the steps of setting the film, said article feeding means and said sealing means at respective reference positions thereof, calculating coordinated positions of the film and said article feeding means, and moving the film and said feeding means to said coordinated positions.

* * * * *